US008973586B2

(12) United States Patent
Walsh

(10) Patent No.: US 8,973,586 B2
(45) Date of Patent: Mar. 10, 2015

(54) DISPOSABLE SMOKING PIPE

(76) Inventor: Randy J. Walsh, Vermillion, SD (US)

( * ) Notice: Subject to any disclaimer, the term of this patent is extended or adjusted under 35 U.S.C. 154(b) by 771 days.

(21) Appl. No.: 13/306,242

(22) Filed: Nov. 29, 2011

(65) Prior Publication Data

US 2013/0133672 A1 May 30, 2013

(51) Int. Cl.
*A24F 1/32* (2006.01)
*A24F 1/28* (2006.01)

(52) U.S. Cl.
CPC .... *A24F 1/28* (2013.01); *A24F 1/32* (2013.01)
USPC ..... 131/230

(58) Field of Classification Search
CPC ..... A24F 1/28; A24F 1/32
See application file for complete search history.

(56) References Cited

U.S. PATENT DOCUMENTS

| | | | | |
|---|---|---|---|---|
| 67,299 | A | | 7/1867 | Hawley |
| 375,140 | A | | 12/1887 | Eccles |
| 387,041 | A | | 7/1888 | Blake |
| 387,135 | A | | 7/1888 | Blake |
| 389,889 | A | | 9/1888 | Hirschl |
| 401,464 | A | | 4/1889 | Ruth |
| 486,296 | A | | 11/1892 | Pfortner |
| 541,156 | A | | 6/1895 | Ferguson |
| 615,027 | A | | 11/1898 | Jaque |
| 906,145 | A | | 12/1908 | Madlem |
| 909,087 | A | | 1/1909 | Hausmann |
| 938,443 | A | | 10/1909 | Tyner |
| 1,455,396 | A | | 5/1923 | Hesson |
| 1,617,113 | A | | 2/1927 | Hirschl |
| 1,793,852 | A | | 2/1931 | Hitt |
| 1,993,019 | A | | 3/1935 | Schellinger |
| 2,027,457 | A | | 1/1936 | Strutz |
| 2,068,866 | A | | 1/1937 | Pedery |
| 2,073,606 | A | | 3/1937 | Cardin |
| 2,074,457 | A | | 3/1937 | Carter |
| 2,101,740 | A | | 12/1937 | Hirschl |
| 2,581,169 | A | | 1/1952 | Bugg |
| 2,644,464 | A | | 7/1953 | Lancaster |
| RE23,924 | E | | 1/1955 | Bugg |
| 2,821,987 | A | * | 2/1958 | Sutter Roser B ..... 131/198.1 |
| 3,122,145 | A | | 2/1964 | St Louis |
| 3,283,763 | A | | 11/1966 | Cholet |
| 3,292,639 | A | | 12/1966 | Zarikta |
| 3,397,703 | A | | 8/1968 | Otto |
| 3,902,505 | A | | 9/1975 | Carleton |
| 4,190,150 | A | | 2/1980 | Bresell |
| 5,678,573 | A | | 10/1997 | Aldin, Sr. |
| 6,182,669 | B1 | | 2/2001 | Van Der Elst |
| 6,698,435 | B2 | | 3/2004 | Miller |
| 2006/0016454 | A1 | | 1/2006 | Wilson |
| 2008/0053466 | A1 | | 3/2008 | Nathanson |
| 2009/0235939 | A1 | | 9/2009 | Gonsalves |
| 2011/0079231 | A1 | | 4/2011 | Borushek et al. |

* cited by examiner

*Primary Examiner* — Michael J Felton
(74) *Attorney, Agent, or Firm* — Jeffrey A. Proehl; Woods, Fuller, Shultz & Smith, PC

(57) ABSTRACT

A disposable smoking pipe may comprise a shaft having a mouthpiece end and a bowl end, a recess being formed in the bowl end, a mouth opening formed in the mouthpiece end, and a passage extending from the mouth opening to the recess to put the recess in fluid communication with the mouth opening. The shaft has an exterior surface with a generally cylindrical in shape between the mouthpiece end and the bowl end, and the shaft is formed from a corncob.

19 Claims, 1 Drawing Sheet

DISPOSABLE SMOKING PIPE

BACKGROUND

Field

The present disclosure relates to smoking devices and more particularly pertains to a new disposable smoking pipe which may be natural, disposable and readily biodegradable.

SUMMARY

In one aspect, the present disclosure relates to a disposable smoking pipe comprising a shaft having a mouthpiece end and a bowl end, a recess being formed in the bowl end, a mouth opening formed in the mouthpiece end, and a passage extending from the mouth opening to the recess to put the recess in fluid communication with the mouth opening. The shaft may have an exterior surface with a generally cylindrical shape between the mouthpiece end and the bowl end, and the shaft is formed from a corncob.

In one aspect, the present disclosure relates to a disposable smoking pipe comprising a shaft having a mouthpiece end and a bowl end, a recess being formed in the bowl end, a mouth opening formed in the mouthpiece end, and a passage extending from the mouth opening to the recess to put the recess in fluid communication with the mouth opening. The passage may be substantially straight from the mouth opening at the mouthpiece end to the recess at the bowl end. The shaft has an exterior surface between the mouthpiece end and the bowl end. The shaft is entirely formed from a corncob.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
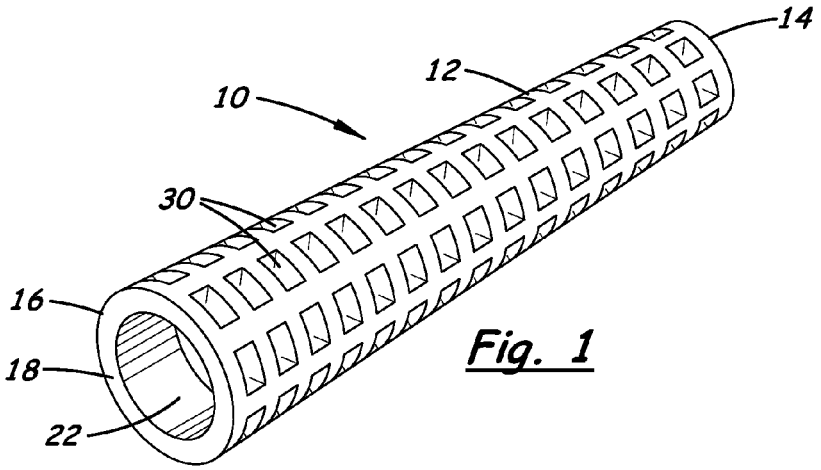
FIG. 1 is a schematic perspective view of a new disposable smoking pipe according to the present disclosure.
Figure 2:
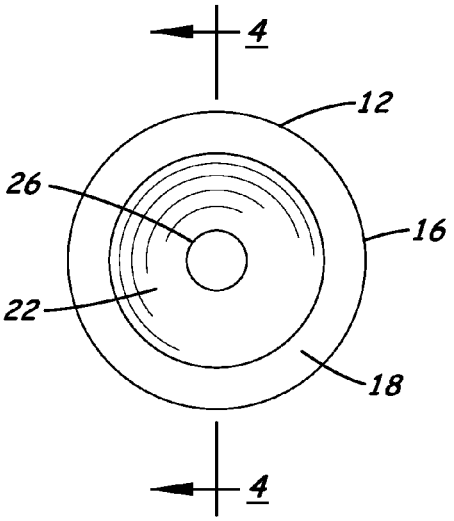
FIG. 2 is a schematic bowl end view of the pipe, according to an illustrative embodiment.
Figure 3:
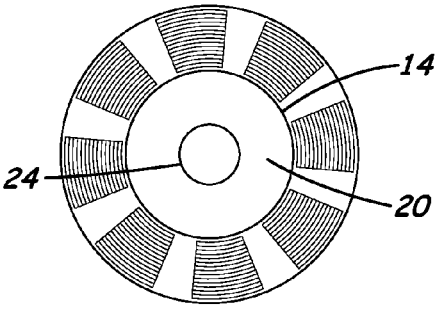
FIG. 3 is a schematic mouthpiece end view of the pipe, according to an illustrative embodiment.
Figure 4:
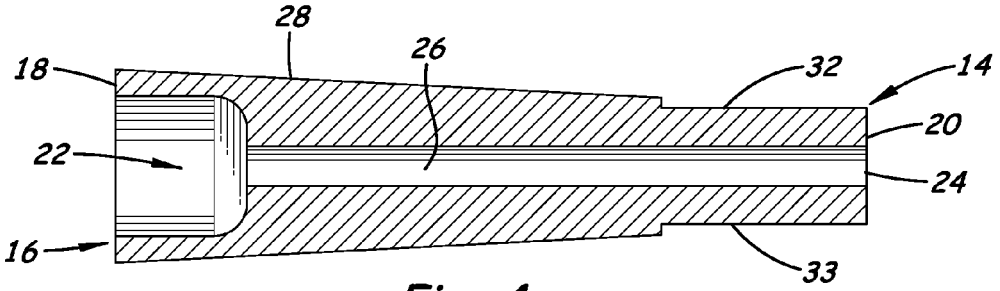
FIG. 4 is a schematic sectional view of the pipe taken along line 4-4 of FIG. 2, according to an illustrative embodiment.

With reference now to the drawings, and in particular to FIGS. 1 through 4 thereof, a new disposable smoking pipe embodying the principles and concepts of the disclosed subject matter will be described.

The disclosure relates to a disposable smoking pipe 10 that may be used to smoke tobacco or other herbaceous material. The material to be smoked either by heating or burning typically includes dried leaves of plants.

The smoking pipe 10 may include a shaft 12 that is configured to be held by the hand, and more specifically the fingers, of the smoker. The pipe 10 may have a mouthpiece end 14 and a bowl end 16 at a location opposite of the mouthpiece end. The bowl end 16 has a bowl end surface 18 and the mouthpiece end 14 has a mouthpiece end surface 20. In some embodiments, the bowl end surface 18 and the mouthpiece end surface 20 are oriented substantially parallel to each other, although this relationship is not critical.

A recess 22 may be formed in the bowl end 16 of the shaft 12 for receiving a quantity of material to be burned. The recess 22 may extend into the bowl end surface 18 toward the mouthpiece end 14. A portion of the recess 22 may be substantially cylindrical in shape, and a portion of the recess may be semispherical in shape. A mouth opening 24 may be formed in the mouthpiece end 14, and may be substantially circular in shape.

A passage 26 may extend from the mouth opening 24 to the recess 22 to put the recess in fluid communication with the mouth opening to thereby allow smoke from burning materials in the recess to reach the mouth opening when the smoker draws on the mouth opening. The passage 26 may be substantially straight and linear in shape from the mouth opening 24 to the recess 22.

The shaft 12 has an exterior surface 28 which may be gripped by the hand of the smoker when the pipe is being used. The exterior surface 28 may be generally cylindrical in shape between the mouthpiece end and the bowl end. The exterior surface 28 has a diameter, and the diameter of the exterior surface at the mouthpiece end may be relatively smaller than the diameter of the exterior surface at the bowl end so that the exterior surface tapers smaller toward the mouthpiece end. In some embodiments, the exterior surface 28 may have a plurality of dimples 30 or small indentations that may enhance the finger grippability of the exterior surface. The dimples 30 may be aligned in rows that extend from the mouthpiece end 14 to the bowl end 16, although the rows may only extend for a portion of the length. The exterior surface 28 may have a pair of flattened surface portions 32, 33 that are positioned toward the mouthpiece end 14 of the shaft that provides flats for being contacted by the lips of the smoker so that the lips have broader flat surfaces for the lips to rest on. The flattened surface portions 32, 33 may be positioned on opposite sides of the exterior surface to correspond to the positions of the upper and lower lips, respectively, when the smoker has the pipe in his or her mouth.

Significantly, the shaft 12 is formed from a corncob. For the purposes of this description, the term "corncob" is intended to indicate the center core of an ear of corn to which the kernels are normally attached, but have been removed. The corncob is also typically in a dried condition. The shaft 12 may be fully and completely formed from a corncob to form a completely natural and easily biodegradable pipe. The passage 26 may extend through the relatively softer pith of the corncob, which is surrounded by a relatively harder or firmer cylindrical shell to which the kernels have been removed. The dimples 30 may be formed by the cavities into which the roots of the kernels of the ear of corn extend. The recess 22 may be formed by removing a portion of the pith of the corncob at the bowl end 16, and may be removed to the border where the pith meets the cylindrical shell, so that the shell forms a solid perimeter about the recess. The exterior surface of the shaft 12 may be formed by removing an outer layer of the corncob, such as by cutting or grinding, to provide a relatively smoother exterior surface that may include the rows of dimples, and the more material removed from the shell, the shallower the dimples may be.

The pipe 10 is thus formed of a natural and relatively inexpensive material that is biodegradable when disposed. The pipe 12 is intended to be disposable after one use, although the pipe may be used more than one time although the usability may degrade. The type of corncob utilized is not critical to the invention, although sweet corn cobs and corn cobs from corn used for grain and feeding cattle have been used. The form of the pipe does not include appendages or other elements added to the corncob shaft, thus simplifying the structure of the pipe for making the pipe, and minimizing the amount of materials utilized in forming the pipe, particularly as the pipe is intended to be used less than a few times and discarded, thus also minimizing the burden on landfills.

In some illustrative embodiments of the pipe 10, the length of the shaft from the mouthpiece end to the bowl end may be from approximately 1.5 inches to approximately 5 inches, and the most preferred lengths are from approximately 2 inches to approximately 4 inches. The end surfaces are generally, although not necessarily perfectly, round. The mouthpiece end may have a diameter of less than approximately 0.75 inches, and some of the most preferred embodiments from approximately 0.4 inches to approximately 0.6 inches. The bowl end may also be round, although in many cases not perfectly so, and may have a diameter of less than approximately 1 inch, and may be from approximately 0.5 inches to approximately 1 inch.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A disposable smoking pipe comprising: a shaft having a mouthpiece and a bowl; the bowl comprising a recess formed in a bowl end of the shaft; a mouth opening formed in a mouthpiece end of the shaft; a passage extending from the mouth opening to the recess to put the recess in fluid communication with the mouth opening; wherein the shaft has an exterior surface with a generally cylindrical in shape between the mouthpiece end and the bowl end; and wherein the shaft is formed from a corncob.

2. The pipe of claim 1 wherein the shaft is fully formed from the corncob.

3. The pipe of claim 1 wherein the passage extends through the pith of the corncob, the recess being formed by removing a portion of the pith of the corncob at the bowl end.

4. The pipe of claim 1 wherein the passage is substantially straight from the mouth opening at the mouthpiece end to the recess at the bowl end.

5. The pipe of claim 1 wherein the exterior surface of the shaft has a diameter, the diameter of the exterior surface at the mouthpiece end being relatively smaller than the diameter of the exterior surface at the bowl end.

6. The pipe of claim 1 wherein the bowl end has a bowl end surface and the mouthpiece end has a mouthpiece end surface, the bowl end surface and the mouthpiece end surface being oriented substantially parallel to each other.

7. The pipe of claim 1 wherein the bowl end has a bowl end surface, the recess extending into the bowl end surface, a portion of the recess being substantially cylindrical in shape.

8. The pipe of claim 1 wherein the exterior surface of the shaft has a plurality of dimples.

9. The pipe of claim 1 wherein the dimples being formed by cavities for the kernels of the ear of corn.

10. The pipe of claim 9 wherein the dimples are aligned in rows extending between the mouthpiece end and the bowl end.

11. The pipe of claim 1 wherein the exterior surface of the shaft has a pair of flattened surface portions positioned toward the mouthpiece end, the flattened surface portions being positioned on opposite sides of the exterior surface.

12. A disposable smoking pipe comprising:

a shaft having a mouthpiece and a bowl;

the bowl comprising a recess formed in a bowl end of the shaft;

a mouth opening formed in the mouthpiece end of the shaft;

a passage extending from the mouth opening to the recess to put the recess in fluid communication with the mouth opening, the passage being substantially straight from the mouth opening at the mouthpiece end to the recess at the bowl end;

wherein the shaft has an exterior surface between the mouthpiece end and the bowl end; and wherein the shaft is entirely formed from a corncob.

13. The pipe of claim 12 wherein the exterior surface of the shaft has a diameter, the diameter of the exterior surface at the mouthpiece end being relatively smaller than the diameter of the exterior surface at the bowl end.

14. The pipe of claim 12 wherein the bowl end has a bowl end surface and the mouthpiece end has a mouthpiece end surface, the bowl end surface and the mouthpiece end surface being oriented substantially parallel to each other.

15. The pipe of claim 12 wherein the bowl end has a bowl end surface, the recess extending into the bowl end surface, a portion of the recess being substantially cylindrical in shape.

16. The pipe of claim 12 wherein the exterior surface of the shaft has a plurality of dimples.

17. The pipe of claim 16 wherein the dimples are aligned in rows extending between the mouthpiece end and the bowl end.

18. The pipe of claim 12 wherein the exterior surface of the shaft has a pair of flattened surface portions positioned toward the mouthpiece end, the flattened surface portions being positioned on opposite sides of the exterior surface.

19. The pipe of claim 12 wherein the exterior surface of the shaft has a diameter, the diameter of the exterior surface at the mouthpiece end being relatively smaller than the diameter of the exterior surface at the bowl end;

wherein the bowl end has a bowl end surface and the mouthpiece end has a mouthpiece end surface, the bowl end surface and the mouthpiece end surface being oriented substantially parallel to each other;

wherein the recess extends into the bowl end surface, a portion of the recess being substantially cylindrical in shape;

wherein the exterior surface of the shaft has a plurality of dimples, the dimples being aligned in rows extending between the mouthpiece end and the bowl end; and wherein the exterior surface of the shaft has a pair of flattened surface portions positioned toward the mouthpiece end, the flattened surface portions being positioned on opposite sides of the exterior surface.

* * * * *